US007775805B2

(12) United States Patent
Liao et al.

(10) Patent No.: US 7,775,805 B2
(45) Date of Patent: Aug. 17, 2010

(54) ELECTRICAL TERMINAL

(75) Inventors: Fang-Jwu Liao, Tu-Cheng (TW); Jia-Hau Liu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/431,696

(22) Filed: Apr. 28, 2009

(65) Prior Publication Data

US 2009/0269950 A1 Oct. 29, 2009

(30) Foreign Application Priority Data

Apr. 28, 2008 (TW) ..... 97207287 U

(51) Int. Cl.
*H01R 12/00* (2006.01)

(52) U.S. Cl. ..... 439/66; 439/862

(58) Field of Classification Search ..... 439/66, 439/862, 71

See application file for complete search history.

(56) References Cited

U.S. PATENT DOCUMENTS 6,585,527 B2 7/2003 Koopman
7,278,864 B2 * 10/2007 Tsai ..... 439/83
2005/0250353 A1 * 11/2005 Soh ..... 439/66
2007/0015377 A1 * 1/2007 Lee et al. ..... 439/66
2007/0042615 A1 * 2/2007 Liao ..... 439/66
2008/0050940 A1 * 2/2008 Lin et al. ..... 439/66

* cited by examiner

*Primary Examiner*—Hien Vu
(74) *Attorney, Agent, or Firm*—Andrew C. Cheng; Wei Te Chung; Ming Chieh Chang

(57) ABSTRACT

An electrical terminal (30) received in an insulative housing (10), comprising: a main portion (31); a first contacting portion (32); a second contacting portion (33); wherein the first contacting portion comprises at least a flexible arm (321) and at least an inflexible arm (322), the flexible arm can be flexed along an up-to-down direction, and the inflexible arm hard to flex along the up-to-down direction, the flexible and inflexible arms defines a flexible contacting portion (3210) and inflexible contacting portion (3220), respectively. The flexible contacting portion is higher than the inflexible contacting portion along the up-to-down direction, the flexible contacting portion and the inflexible contacting portion are both contacted to a same corresponding electrical contacting portion; the insulative housing defining a plurality of holes, the main portion of the terminal been fixed in the hole, and the first and second contacting portion extending externally from the insulative housing.

5 Claims, 4 Drawing Sheets

ELECTRICAL TERMINAL

BACKGROUND OF THE INVENTION

1. Field of the Invention

The present invention relates to an electrical terminal arranged electrical connector, and more particularly to an electrical terminal arranged in LGA (Land Grid Array) connector.

2. Description of Prior Arts

Usually, the LGA connector disposed on an upper surface of a PCB (print circuit board) is used to receive a CPU (central processing unit), and a plurality of terminals are arranged in the LGA connector. The lower surface of the CPU defines a plurality of electrical pieces, and the upper surface of the PCB forms a plurality of electrical traces. The terminals electrically connect with the electrical pieces and the electrical traces. As the computer developing, the structure of the computer is more and more complex, the accessories of the computer are required more precise and accurate. The U.S. Pat. No. 6,585,527 discloses an LGA terminal, the LGA terminal has a flexible arm, the flexible arm contacts with the CPU, and the terminal includes only one contacting point, one contacting measure to contact with the CPU. The flexible arm is not protected by other structure and will suffer fatigue damage. Then the electrical connecting between the LGA terminal and the CPU will be broken when the terminal is damaged.

Therefore, it is desirable to provide a new electrical terminal that eliminates the aforesaid problems.

SUMMARY OF THE INVENTION

Accordingly, an object of the present invention is to provide an electrical terminal which includes more than one contacting point.

In the exemplary embodiment of the invention, an electrical terminal received in an insulative housing, comprises: a main portion; a first contacting portion; a second contacting portion; wherein the first contacting portion comprises at least a flexible arm and at least an inflexible arm, the flexible arm can be flexed along an up-to-down direction, and the inflexible arm hard to flex along the up-to-down direction, the flexible arm defines a flexible contacting portion, and the inflexible arm defines an inflexible contacting portion, the flexible contacting portion is higher than the inflexible contacting portion along the up-to-down direction, the flexible contacting portion and the inflexible contacting portion are both contacted to a same corresponding electrical contacting portion; the insulative housing defines a plurality of holes, the main portion of the terminal been fixed in the hole, and the first and second contacting portion extending externally from the insulative housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
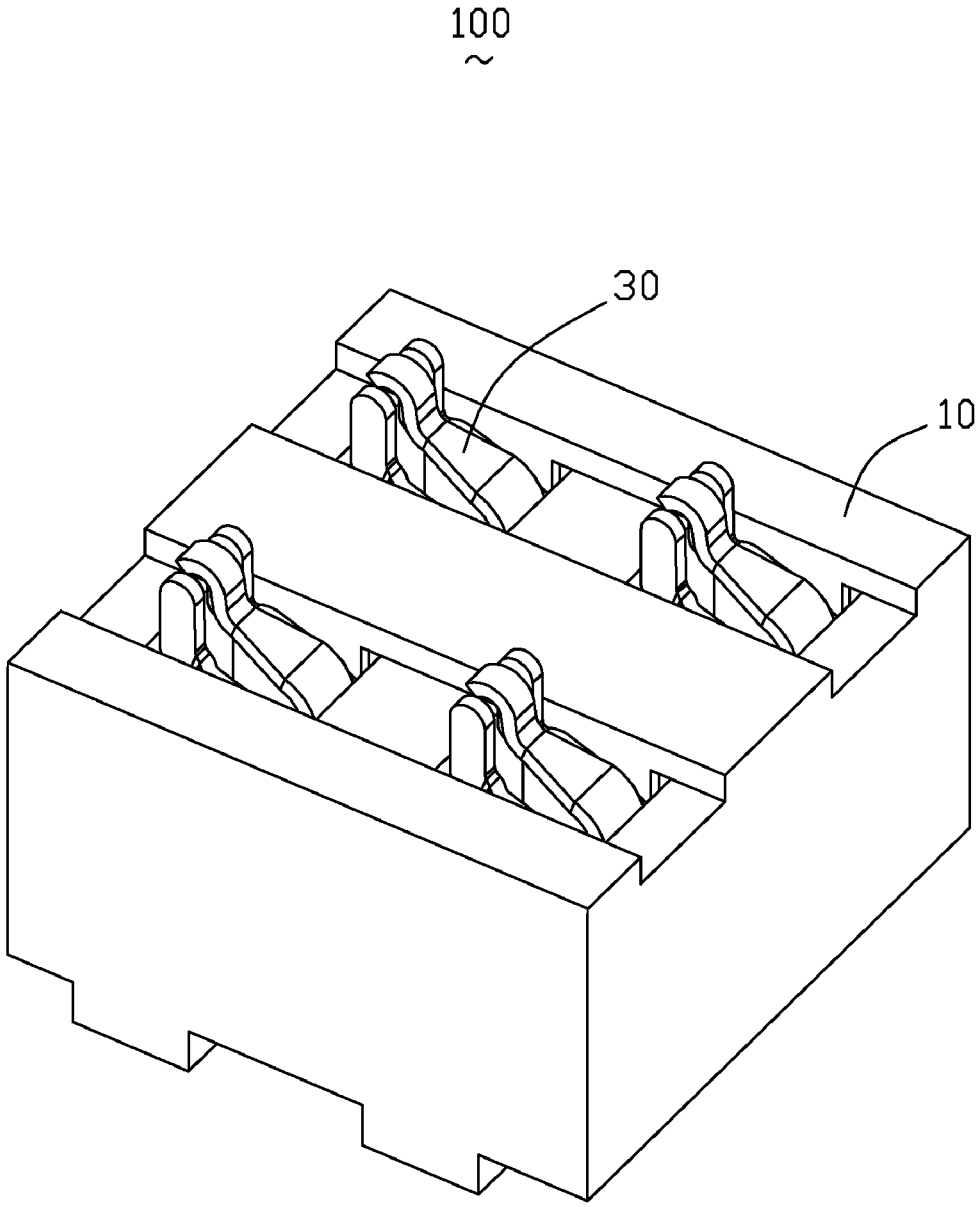
FIG. 1 is a perspective view of an electrical terminal disposed in a receptacle connector.
Figure 2:
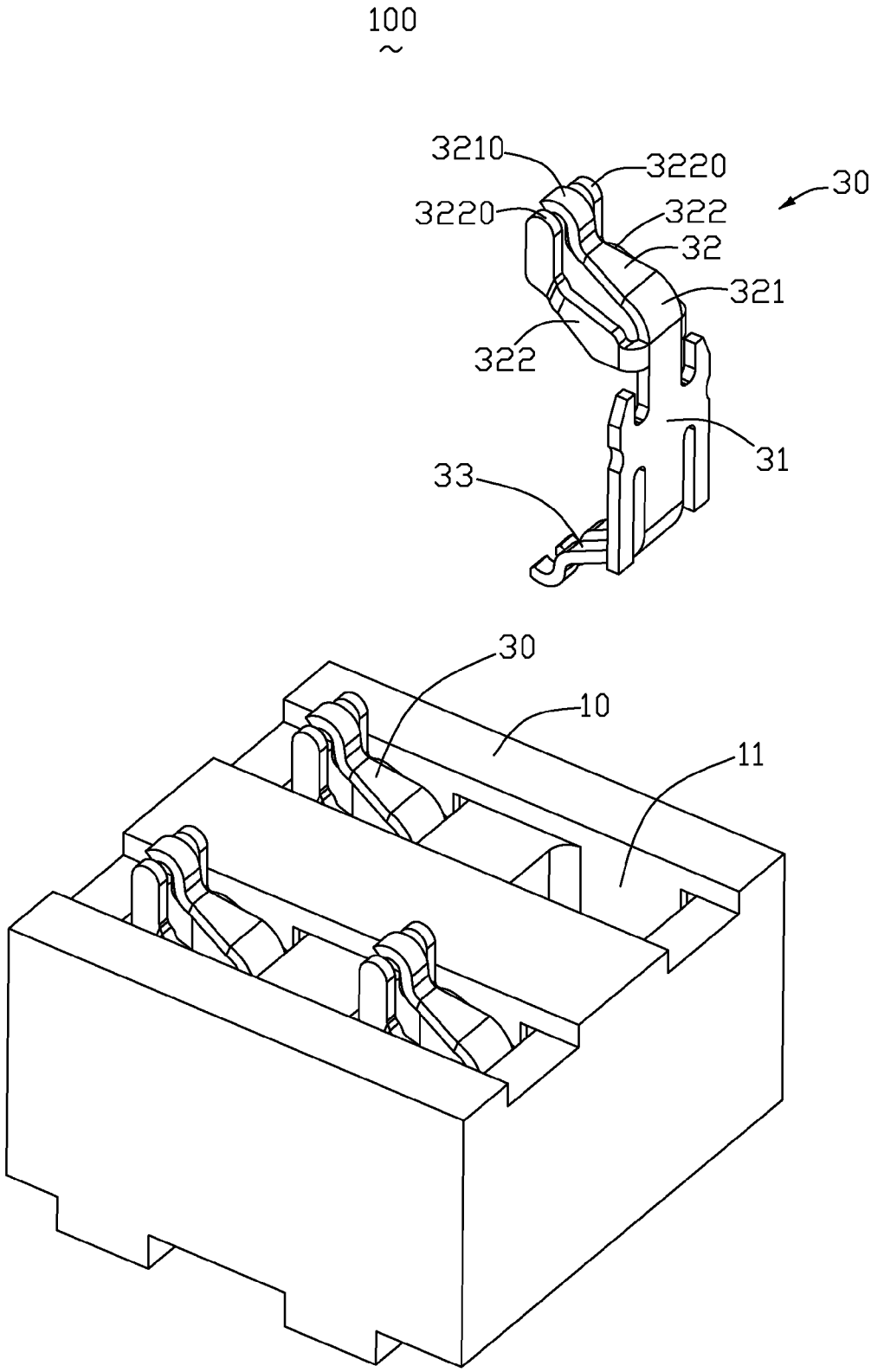
FIG. 2 is an exploded view of the receptacle connector.
Figure 3:
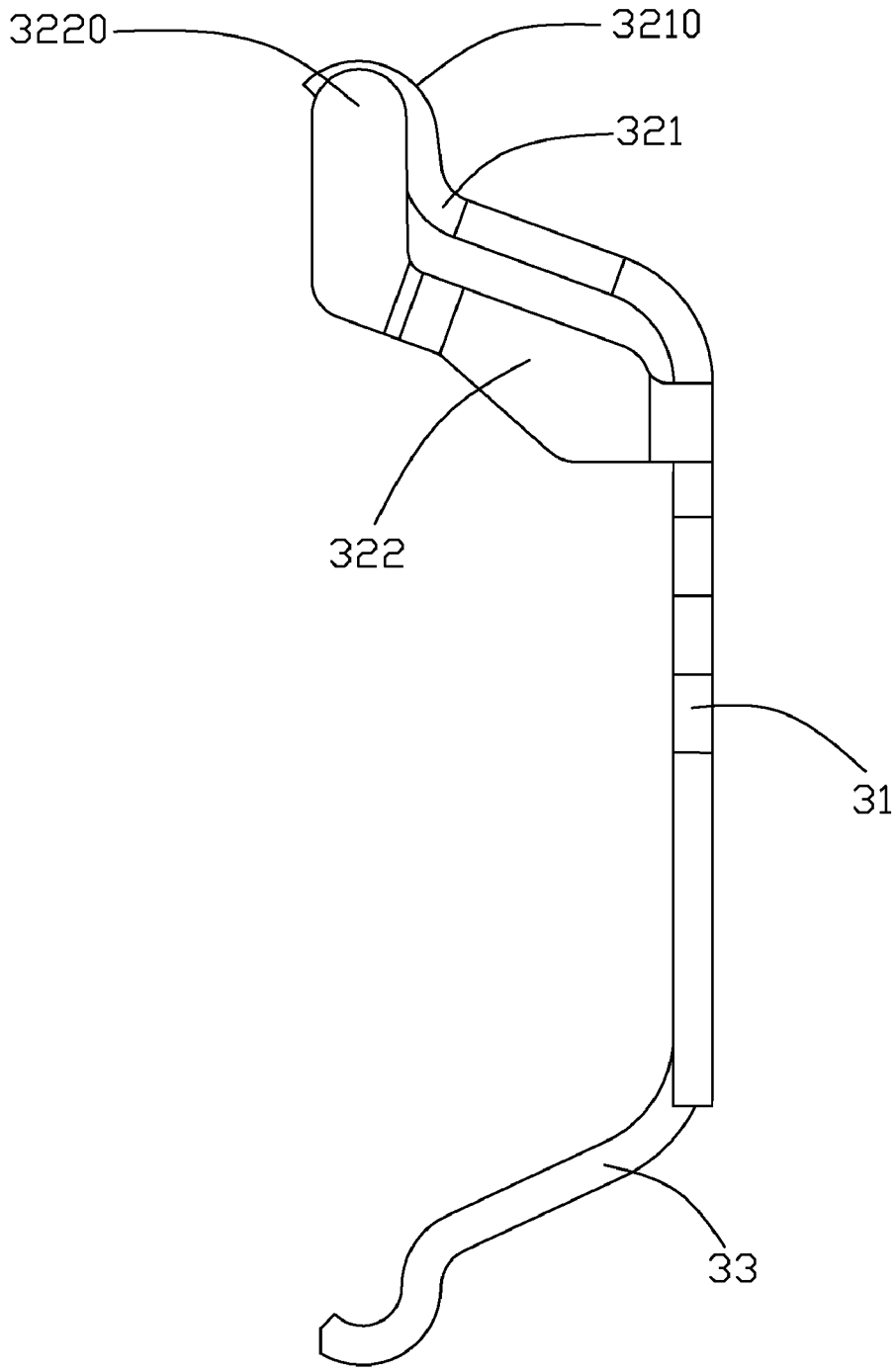
FIG. 3 is a perspective view of the electrical terminal of the present invention.

Referring to FIGS. 1 to 3, an electrical terminal 30 is disposed in a receptacle connector 100. The receptacle connector 100 is disposed on a PCB (print circuit board) (not shown) to receive a CPU (central processing unit) (not shown), and comprises an insulative housing 10 and a plurality of said terminals 30. The PCB defines a plurality of electrical traces, and the terminals 30 are electrically connected to the corresponding electrical traces of the PCB.

Referring to FIG. 3, the insulative housing 10 is configured of cube. The insulative housing 10 defines a plurality of holes 11, the holes 11 perforate the insulative housing 10 from the upper surface 12 to the lower surface 13. Said terminals 30 are received in the holes 11. We define the holes are along an up-to-down direction.

Figure 4:
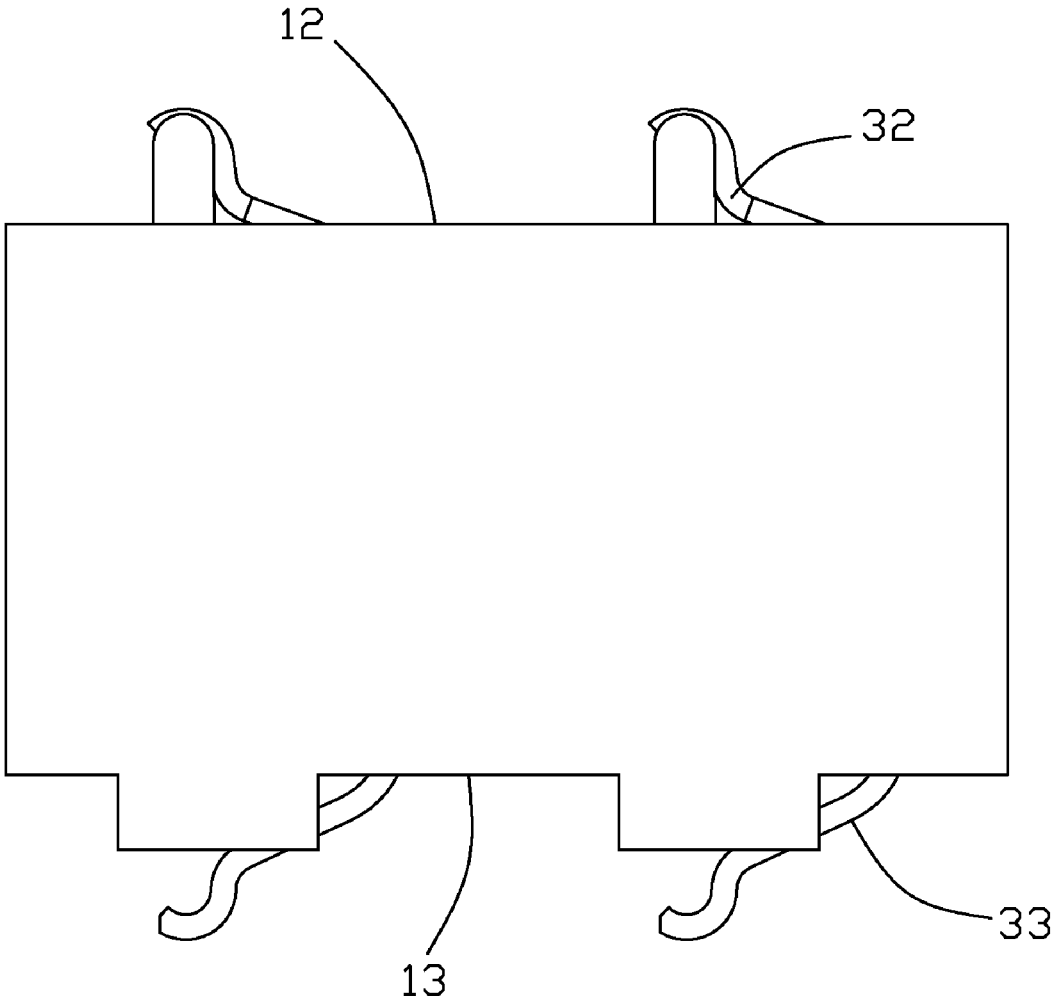
FIG. 4 is a front elevational view of the receptacle connector according to the FIG. 1.

Referring to FIGS. 2 to 4, the electrical terminal 30 comprises a main portion 31 and a first and second contacting portion 32, 33. The main portion 31 is fixed in the hole 11, and the first and second contacting portion 32, 33 are used to electrically connected to the CPU and electrical trace of the PCB, respectively. After the main portion 31 fixed in the hole 11, the first and second contacting portions 32, 33 extend externally from the upper and lower surface 12, 13, respectively.

Referring to FIGS. 2 to 4, the first contacting portion 32 of the electrical terminal 30 includes a flexible arm 321 and a pair of inflexible arm 322 disposed on the opposite sides of the flexible arm 321. Wherein, the flexible arm 321 and the inflexible 321 arm are relatively to the up-to-down direction. Along the up-to-down direction, the flexible arm 321 is more easy to bend rather than along the horizontal direction. The up-to-down direction is perpendicular to the horizontal direction, and the inflexible arm 322 is more easy to bend along the horizontal direction rather than the up-to-down direction. The distal end of the flexible arm 321 defines a flexible contacting portion 3210. The flexible contacting portion 3210 can flex along the up-to-down direction while the flexible arm 321 flexing. And the flexible contacting portion 3210 has an arc outer surface. The distal ends of the pair inflexible arms 322 have inflexible contacting portion 3220, respectively. The inflexible contacting portion 3220 can not flex along the up-to-down direction because of the inflexible arm 322.

When the CPU assembles to the receptacle connector 100, the flexible contacting portion 3210 of the first contacting portion 32 meets the CPU first, and then, the CPU presses the flexible contacting portion 3210 along the up-to-down direction downwardly, until the CPU engages with the inflexible contacting portion 3220. When the CPU is pressing the flexible contacting portion 3210 downwardly, the flexible contacting portion 3210 slides on the CPU, and the arc outer surface of the flexible contacting portion 3210 help the flexible contacting portion 3210 easy to slide. As the CPU engaging with the inflexible portion 3210, the inflexible portion 3220 stops the CPU going to press the flexible contacting portion 3210 downwardly.

Now, the CPU both engages with the flexible contacting portion 3210 and the inflexible contacting portion 3220. There are more than one contacting portion and one contacting measure between the CPU and the electrical terminal 30. And the inflexible contacting portion 3220 can prevent the flexible contacting portion 3210 from fatigue damage. When the inflexible contacting portion does not engage with the CPU, the flexible contacting portion 3210 can ensure the electrical connecting between the CPU and the terminal 30. In this embodiment, the flexible arm 321 and inflexible arm 322 are extended from a same end of the terminal 30, according to the different situation, the flexible arm 321 and inflexible arm 322 can extend from different part of the terminal 30.

The structures of the first and second contacting portion 32, 33 as shown are different from each other, but they can be same if desired.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical terminal received in an insulative housing, comprising:

a main portion;

a first contacting portion; a second contacting portion;

wherein the first contacting portion comprises a flexible arm and at least one inflexible arm, the flexible arm is flexible along an up-to-down direction, and the inflexible arm hard to flex along the up-to-down direction, the flexible arm defines a flexible contacting portion, and the inflexible arm defines an inflexible contacting portion, the flexible contacting portion is higher than the inflexible contacting portion along the up-to-down direction, the flexible contacting portion and the inflexible contacting portion are both connected to a same corresponding electrical contacting portion;

said insulative housing defining a plurality of holes, the main portion of the terminal being fixed in the hole, and the first and second contacting portion extending outward from the insulative housing;

wherein the first contacting portion comprises a pair of inflexible arms, and there is a pair of inflexible arms arranged on opposite sides of the flexible arm;

wherein the inflexible arms and the flexible arm extend angularly and upwardly at same direction from a same end of the main portion and the second contacting portion extended angularly and downwardly from the other end of the main body;

wherein the first contacting portion is used to contact to a CPU, and the second contacting portion is used to connect to a PCB; and wherein when the CPU is assembled to the terminal, the CPU presses the flexible contacting portion of the first contacting portion downwardly along the up-to-down direction, until the CPU engages with the inflexible contacting portion.

2. The electrical terminal as claimed in claim 1, wherein the insulative housing is rectangular, the plurality of holes perforate the insulative housing from an upper surface thereof to a lower surface thereof and are arranged in an array, and the first and second contacting portions extend outside of opposite ends of the hole.

3. The electrical terminal as claimed in claim 1, wherein when the flexible contacting portion is being pressed downwardly along the up-to-down direction, the flexible contacting portion is sliding on the CPU, and the flexible contacting portion defines an arc outer surface to facilitate the flexible contacting portion to slide.

4. An electrical connector comprising:

an insulative housing defining a plurality of passageways therein; a plurality of contacts disposed in the corresponding passageways, respectively, each of said contacts defining a planar main portion having retention section on two sides thereof, a flexible arm extending angularly and upwardly from an upper end of the main portion, a contacting portion extending angularly and downwardly from a lower end of the main portion, said flexible arm defining a contact tip at a free end and a deflection joint closer to the main portion, the flexible arm being downwardly deflected about the deflection joint when the contact tip is downwardly pressed, a pair of steady arms located by two sides of the flexible arm and extending angularly and upwardly from two side edge of one of the flexible arm and the main portion below said deflection joint, so as to guidably protect the downward movement of the contact tip therebetween;

wherein each of said steady arms essentially extends in a vertical plane;

wherein each of said steady arms extends from the flexible arm;

wherein the contact tip is higher than a tip of the steady arm; and wherein both the contact tip and the tip of the steady arm are higher than a top surface of the housing when the contact is in a relaxed manner.

5. The electrical connector as claimed in claim 4, wherein the steady arm and the flexible arm are both downwardly in a sequential manner that the flexible arm is initially deflected about the deflection joint when the contact tip is downwardly pressed while successively about a joint between the main portion and the flexible arm when the tip of the steady arm is joined to be downwardly pressed under condition that both the flexible arm and the steady arm are downwardly moved commonly and synchronically.

* * * * *